US006632000B2

(12) United States Patent
Chao

(10) Patent No.: US 6,632,000 B2
(45) Date of Patent: Oct. 14, 2003

(54) PEN FOR RECEIVING EYEGLASSES

(75) Inventor: David Chao, Los Altos, CA (US)

(73) Assignee: Contour Optik, Inc., Chiayi (TW)

( * ) Notice: Subject to any disclaimer, the term of this patent is extended or adjusted under 35 U.S.C. 154(b) by 0 days.

(21) Appl. No.: 09/894,791

(22) Filed: Jun. 28, 2001

(65) Prior Publication Data

US 2002/0012564 A1 Jan. 31, 2002

Related U.S. Application Data

(63) Continuation-in-part of application No. 09/607,265, filed on Jun. 30, 2000, now Pat. No. 6,270,274.

(51) Int. Cl.[7] ..... A45C 15/06

(52) U.S. Cl. ..... 362/156; 362/200; 362/208; 362/253; 351/158

(58) Field of Search ..... 362/118, 154, 362/156, 157, 200, 202, 207, 208, 253; 351/158; 401/195

(56) References Cited

U.S. PATENT DOCUMENTS

| | | | | |
|---|---|---|---|---|
| 2,060,406 A | | 11/1936 | Tiede | |
| 2,624,011 A | | 12/1952 | Stern | |
| 2,772,772 A | | 12/1956 | Taylor | |
| 3,549,005 A | | 12/1970 | Kalogris | |
| 3,768,634 A | | 10/1973 | Creevy | |
| 4,149,812 A | | 4/1979 | Huffman, Jr. | |
| D260,905 S | | 9/1981 | Klaber | |
| 4,336,882 A | | 6/1982 | Sakwa | |
| 5,009,535 A | | 4/1991 | Oilar | |
| 5,842,772 A | * | 12/1998 | Stern et al. | 362/253 |
| 5,929,967 A | | 7/1999 | Conner | |
| 5,949,515 A | | 9/1999 | Hoshino | |
| 6,004,597 A | | 12/1999 | Coleman et al. | |
| 6,168,288 B1 | * | 1/2001 | St. Claire | 362/208 |
| 6,270,274 B1 | * | 8/2001 | Chao | 401/195 |

* cited by examiner

*Primary Examiner*—Stephen Husar
(74) *Attorney, Agent, or Firm*—Barry J. Schindler, Esq.; Michael Nicodema, Esq.; Greenberg Traurig LLP

(57) ABSTRACT

A pen or flashlight for receiving eyeglasses includes a pen barrel or housing and a writing tip unit or flashlight unit. The pen barrel or housing includes a body which is adapted to receive a pair of eyeglasses therein, and which has open front and rear ends, and a fixed rear cap which is mounted fixedly on and which closes the rear end of the barrel body or housing. The writing tip or flashlight unit includes an openable front cap which has a front end and a rear end that is attached to and that closes the front end of the barrel body or housing. The writing tip unit also includes a writing tip which is confined within the front cap and which extends from the front end of the front cap. In another embodiment, the flashlight unit is secured to a sidewall of the housing and the housing is formed as two separable portions. One or both ends of the pen barrel or housing may be formed with integrally formed closed end portions and in one embodiment a writing tip is provided at one end of the housing and a flashlight unit is secured to a sidewall thereof. In another embodiment, the eyeglass case comprises a pair of elongated portions hinged at one end with a flashlight positioned at an opposite end such as for illuminating reading material. In another embodiment, the flashlight is provided on a surface of the eyeglass case an projects a light array generally perpendicular thereto. A mirror may also be provided for reflecting an image illuminated by the flashlight.

10 Claims, 13 Drawing Sheets

PEN FOR RECEIVING EYEGLASSES

CROSS-REFERENCE TO RELATED APPLICATIONS

This application is a continuation-in-part of U.S. patent application Ser. No. 09/607,265 filed on Jun. 30, 2000, now U.S. Pat. No. 6,270,274 the disclosure of which is incorporated herein by reference.

BACKGROUND OF THE INVENTION

1. Field of the Invention

The present invention relates to a pen or flashlight having a housing for receiving eyeglasses, more particularly to such a housing having a fixedly mounted or integrally formed rear cap, and an openable front cap with a writing tip or flashlight, which permits access to an interior of the housing for storage of eyeglasses. In another embodiment, the flashlight may be secured to an outer surface of the housing or be integrated into a portion of the housing.

2. Description of the Related Art

Many people wear eyeglasses only on certain occasions. For instance, people suffering from presbyopia usually wear eyeglasses only for reading and close work such as writing. Manufacturers have therefore developed a type of pen that has a receiving space for storing a pair of eyeglasses.

U.S. Pat. No. 5,929,967 teaches a pen for receiving eyeglasses, which includes a hollow pen barrel having a first open end and a second open end. The first open end is provided with a writing tip unit or flashlight while the second open end has a removable cap mounted pivotably thereon to allow access to an interior of the pen barrel for storage of a pair of eyeglasses from the rear end of the pen. While the pivotally connected rear cap can be prevented from loss, such pivotal connection obstructs addition of other accessories, such as a flashlight, to the rear end of the pen. On the other hand, the structure of the rear cap may be weakened by any additional accessory mounted thereon. If the flashlight and the writing tip unit are mounted interchangeably at the front end of the pen, they are inconvenient to carry around and can be misplaced easily. Besides, it is comparatively complicated to provide two removable components at the two ends of the pen in terms of manufacture.

SUMMARY OF THE INVENTION

Therefore, the main object of the present invention is to provide a pen or flashlight which includes a housing for receiving eyeglasses, which overcomes the aforesaid problems.

Accordingly, in a first embodiment a pen for receiving eyeglasses of the present invention includes a pen barrel and a writing tip unit. The pen barrel includes a barrel body which is adapted to receive a pair of eyeglasses therein, and which has open front and rear ends, and a fixed rear cap which is mounted fixedly on and which closes the rear end of the barrel body. The writing tip unit includes an openable front cap which has a front end and a rear end that is attached to and that closes the front end of the barrel body, and a writing tip which is confined within the front cap and which extends from the front end of the front cap.

In another embodiment, the writing tip is replaced by a high intensity light emitting diode and associated power supply. Additionally, a key chain may be secured to the barrel body or housing. In yet another embodiment, the barrel or body comprises two joinable sections each having a closed end and a high intensity light emitting diode and associated power supply is secured to another surface thereof in either a fixed position or pivotably. In yet a further embodiment the housing is in the form of a clam shell housing and includes a high intensity light emitting diode and associated power source secured to the outer surface thereof. In a still further embodiment, the light emitting diode and associated power supply may be integrated into a portion of the housing and a mirror may also be provided on the surface of the case.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1A:
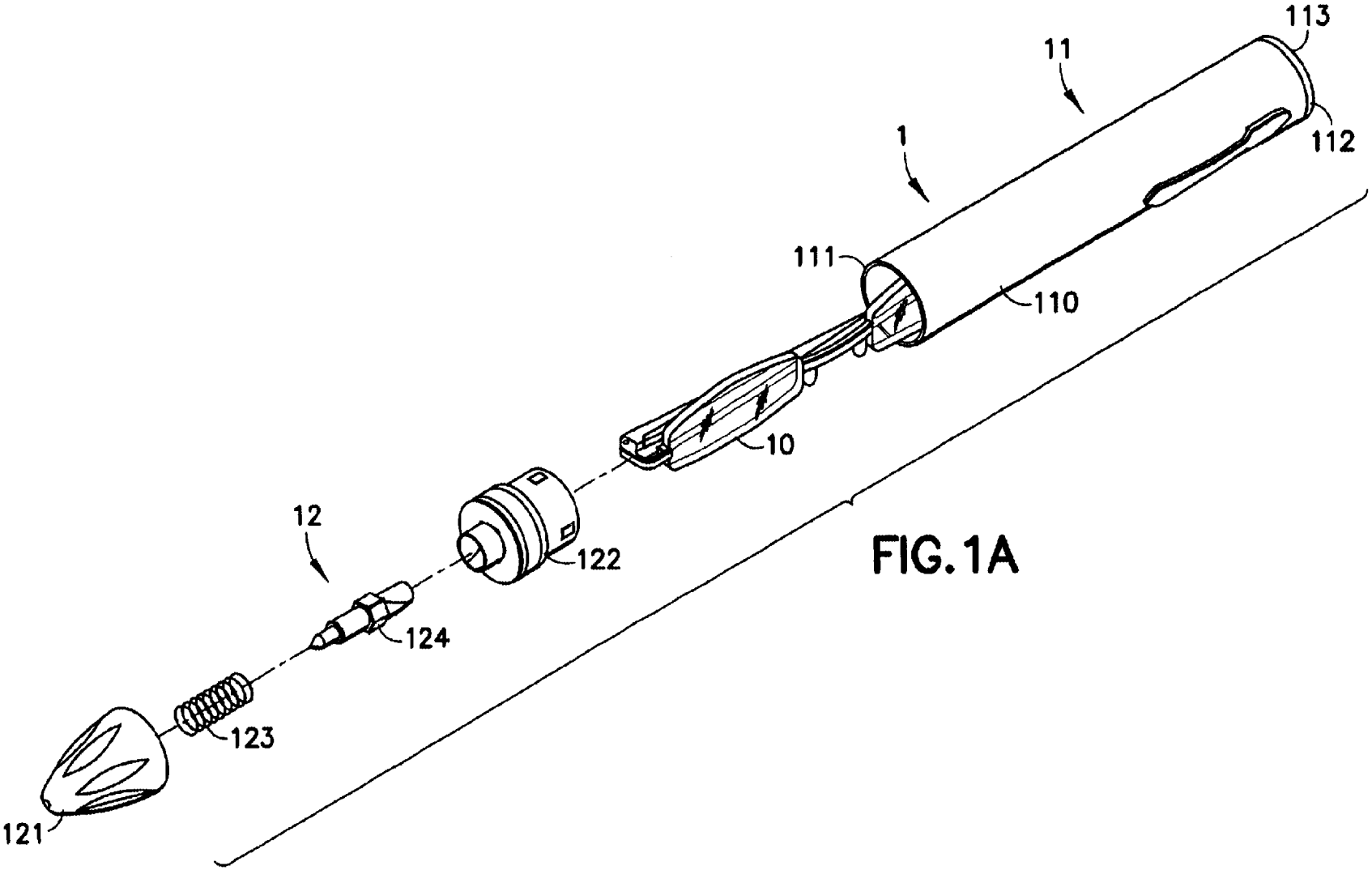
FIG. 1A is a partly exploded perspective view of the first preferred embodiment of a pen for receiving eyeglasses according to the invention.

Before the present invention is described in greater detail, it should be noted that like elements are denoted by the same reference numerals throughout much of the disclosure.

Figure 1B:
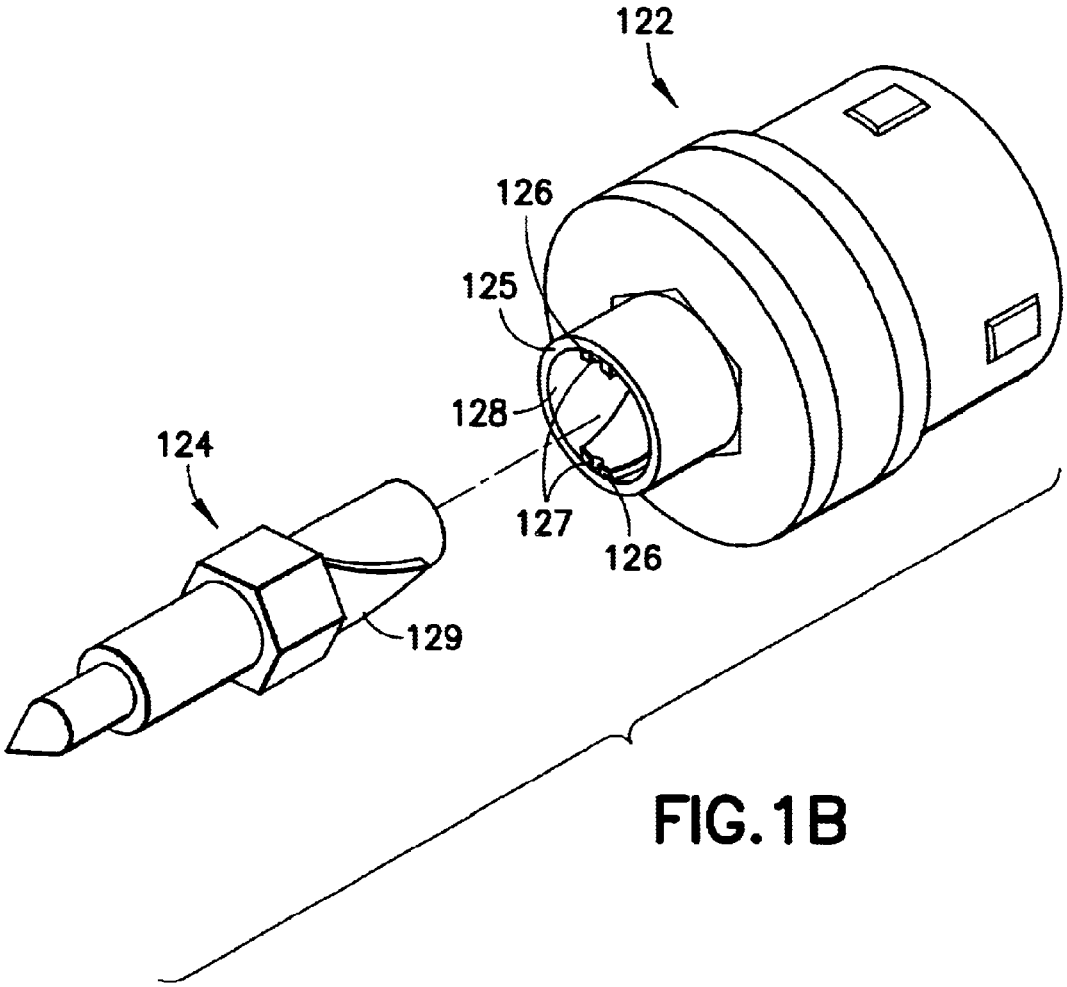
FIG. 1B is an exploded perspective view of a writing tip and a connecting block of the first preferred embodiment.

Referring to FIGS. 1A and 1B, the first preferred embodiment of a pen 1 for receiving eyeglasses according to the present invention is shown to include a pen barrel 11 and a writing tip unit 12. The pen barrel 11 includes a barrel body 110 which is adapted to receive a pair of eyeglasses 10 therein, and which has open front and rear ends 111, 112, and a fixed rear cap 113 which is mounted fixedly on and which closes the rear end 112 of the barrel body 10. The rear cap 113 is press fitted within the rear end 112 of the barrel body 110 such that it cannot be removed from the barrel body 110.

The writing tip unit 12 includes an openable front cap and a writing tip 124. The front cap includes a hollow rotary knob 121 and a connecting block 122 that is attached to and that closes the front end 111 of the barrel body 110. The rotary knob 121 and the connecting block 122 are interengaged such that the rotary knob 121 can rotate relative to the connecting block 122. The connecting block 122 has a front end formed with a cylindrical tip mounting portion 125. The tip mounting portion 125 has an inner surface formed with two opposed, substantially trapezoidal projections 126 such that two substantially triangular recesses 128 are defined therebetween. Each projection 126 has a front end surface formed with a limiting depressed portion 127. The writing tip 124 has a front end portion fitted with a spring 123 for biasing the writing tip 124 to a retracted position, and has a rear end portion provided with two opposed, substantially triangular abutting protrusions 129 that fit into the recesses 128. The connecting block 122 is press fitted within the front end 111 of the barrel body 110 for synchronous rotation therewith, whereas the writing tip 124 is coupled with the rotary knob 121 in a known manner for synchronous rotation therewith. As such, when the rotary knob 121 rotates relative to the barrel body 110 against the biasing action of the spring 123, the writing tip 124 will rotate relative to the connecting block 122, while the abutting protrusions 129 thereof will be pushed by inclined side walls of the recesses 128 until the abutting protrusions 129 are confined by the limiting depressed portions 127. At this time, the writing tip 124 will extend from a front end of the rotary knob 121 for writing purposes. Thereafter, the rotary knob 121 may be rotated to cause the abutting protrusions 129 to displace to the recesses 128 by virtue of the biasing action of the spring 123 so that the writing tip 124 retracts into the rotary knob 121.

When it is desired to stow the eyeglasses 10 in the pen barrel 11 of the pen 1, it is only necessary to remove the writing tip unit 12 from the pen barrel 11 to allow insertion of the eyeglasses 10 via the front end 111 into the barrel body 110. As such, the user may carry the pen 1 around with the eyeglasses 10 stowed thereinside, and may remove the eyeglasses 10 from the pen 1 in a convenient manner any time.

Figure 1C:
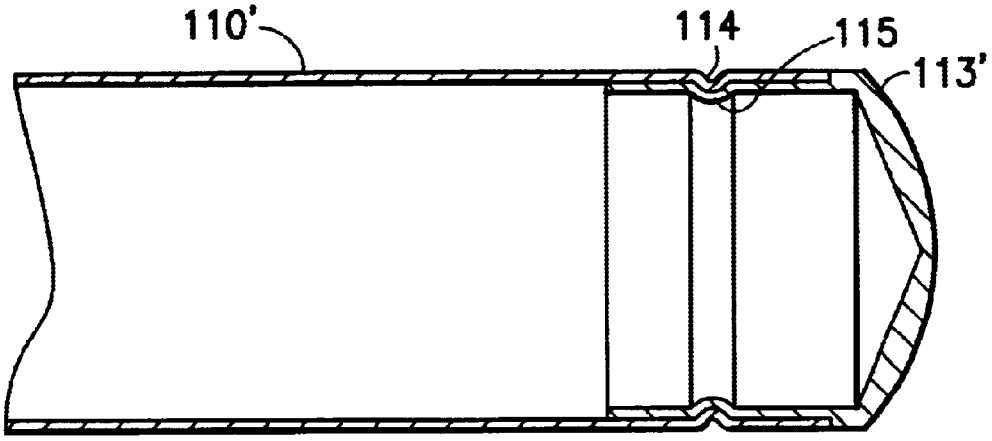
FIG. 1C is a fragmentary sectional view illustrating engagement of a rear cap and a barrel body of the second preferred embodiment of a pen for receiving eyeglasses according to the invention.

Referring to FIG. 1C, in the second preferred embodiment, an outer surface of the rear cap 113' is formed with an annular groove 114. The barrel body 110' is sleeved on the rear cap 113', and has an inner surface formed with an annular projection 115 that engages fittingly the annular groove 114 in the rear cap 113', thereby retaining the rear cap 113' on the barrel body 110'.

Figure 1D:
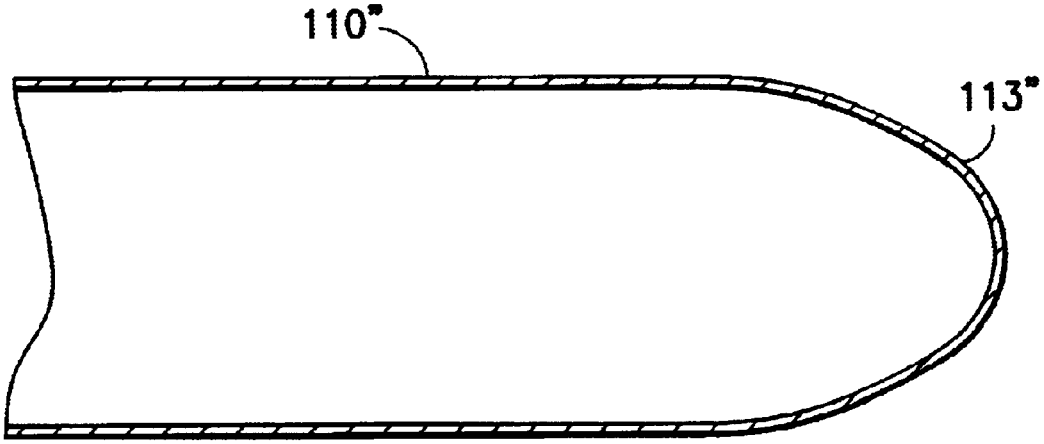
FIG. 1D is a fragmentary sectional view illustrating a rear cap integrally formed with a barrel body of the third preferred embodiment of a pen for receiving eyeglasses according to the invention.

With reference to FIG. 1D, in the third preferred embodiment, the rear cap 113" may be formed integrally with the barrel body 110".

Figure 2:
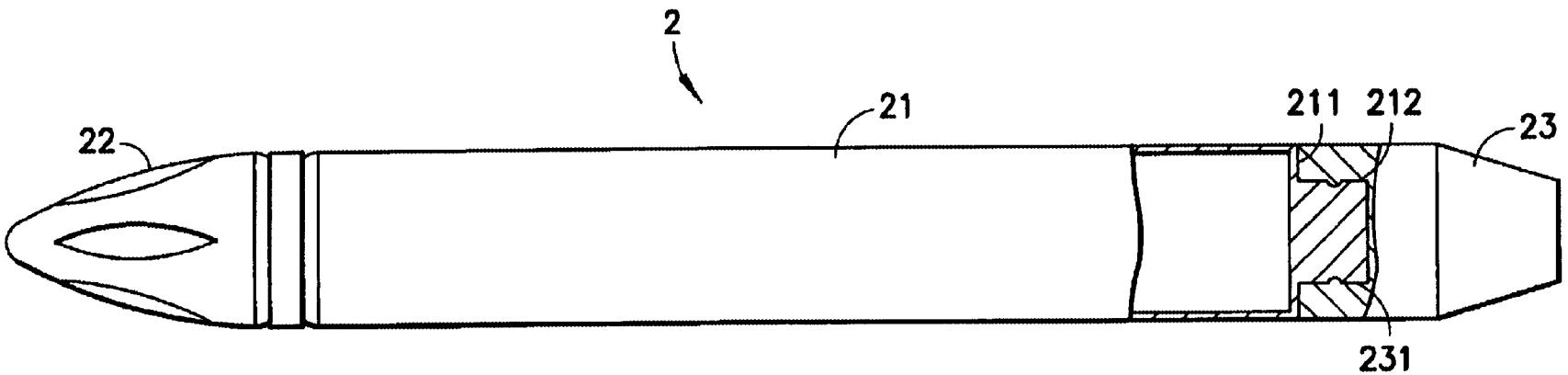
FIG. 2 is a partly sectional view of the fourth preferred embodiment of a pen for receiving eyeglasses according to the invention.

Referring to FIG. 2, the fourth preferred embodiment of a pen 2 according to the present invention is shown to include a pen barrel 21 and a writing tip unit 22. A fixed rear cap 211 is mounted fixedly on and closes a rear end of the pen barrel 21. This embodiment is different from the first preferred embodiment in that a rear end of the rear cap 211 extends rearwardly to form a retaining block 212, and a flashlight 23 is mounted fixedly on the retaining block 212 in such a manner that the retaining block 212 is press fitted within a blind hole 231 in the flashlight 23. Hence, the pen 2 may have an additional lighting function. It should be appreciated that since the flashlight 23 is provided on the rear cap 211 that is mounted fixedly on the rear end of the pen barrel 2, the structure of the pen 2 is relatively strong.

Figure 3:
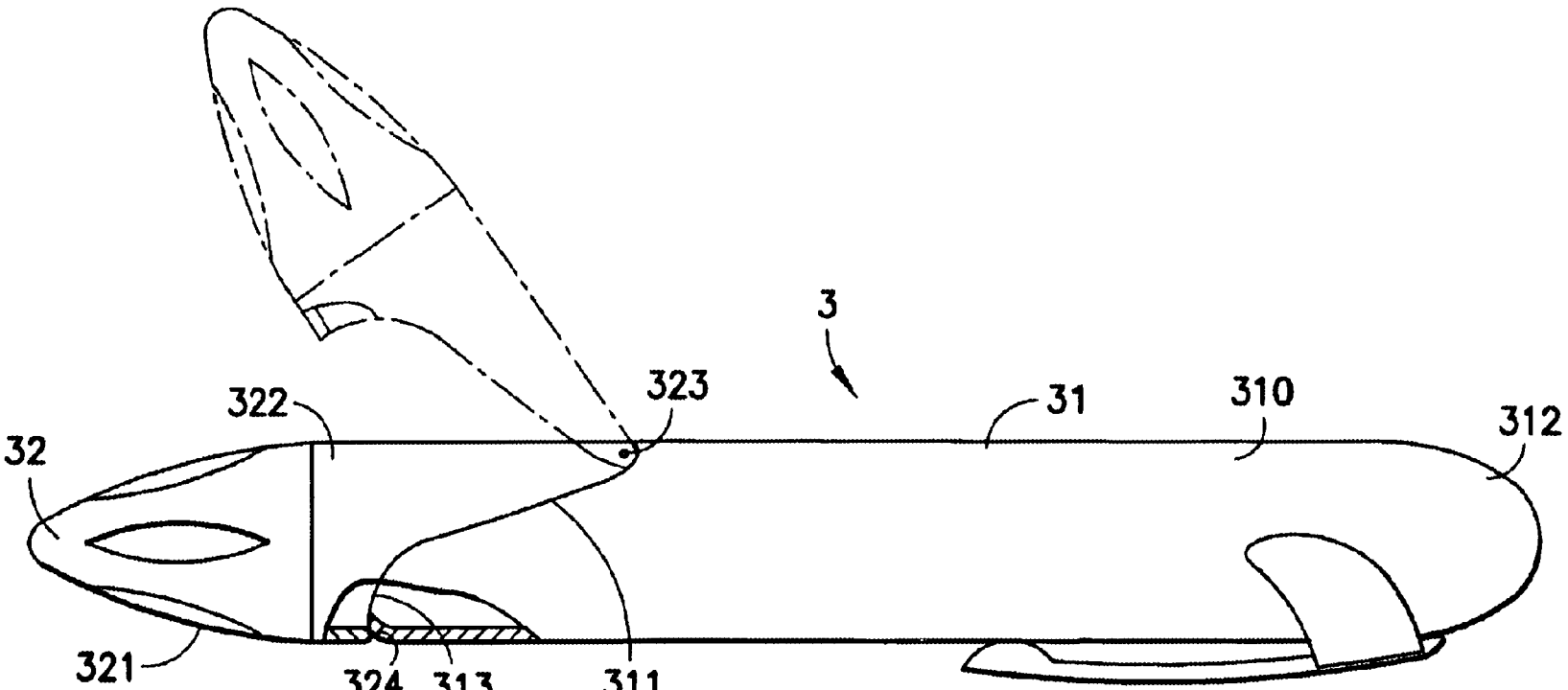
FIG. 3 is partly sectional view of the fifth preferred embodiment of a pen for receiving eyeglasses according to the invention.

Referring to FIG. 3, the fifth preferred embodiment of a pen 3 according to the present invention is shown to include a pen barrel 31 and a writing tip unit 32. Likewise, the writing tip unit 32 includes an openable front cap constituted by a rotary knob 321 and a connecting block 322, and a writing tip (not shown). The pen barrel 31 has a barrel body 310 with an open front end 311 and a rear cap 312 integrally formed with the barrel body 310. This embodiment is different from the first preferred embodiment in that the writing tip unit 32 is formed with a retaining edge 324, whereas the pen barrel 31 is formed with a retaining edge 313 that engages the retaining edge 324 of the writing tip unit 32, thereby positioning the writing tip unit 32 on the pen barrel 31. In addition, the writing tip unit 32 is mounted rotatably on the pen barrel 31 via a pivot portion 323 and is rotatable about an axis, which is perpendicular to the barrel body 310, for opening and closing the front end 311 of the barrel body 310. In this embodiment, since the writing tip unit 32 is mounted pivotally on the pen barrel 31, it remains attached to the pen barrel 31 when lifted to permit access to the interior of the barrel body 310.

Figure 4A:
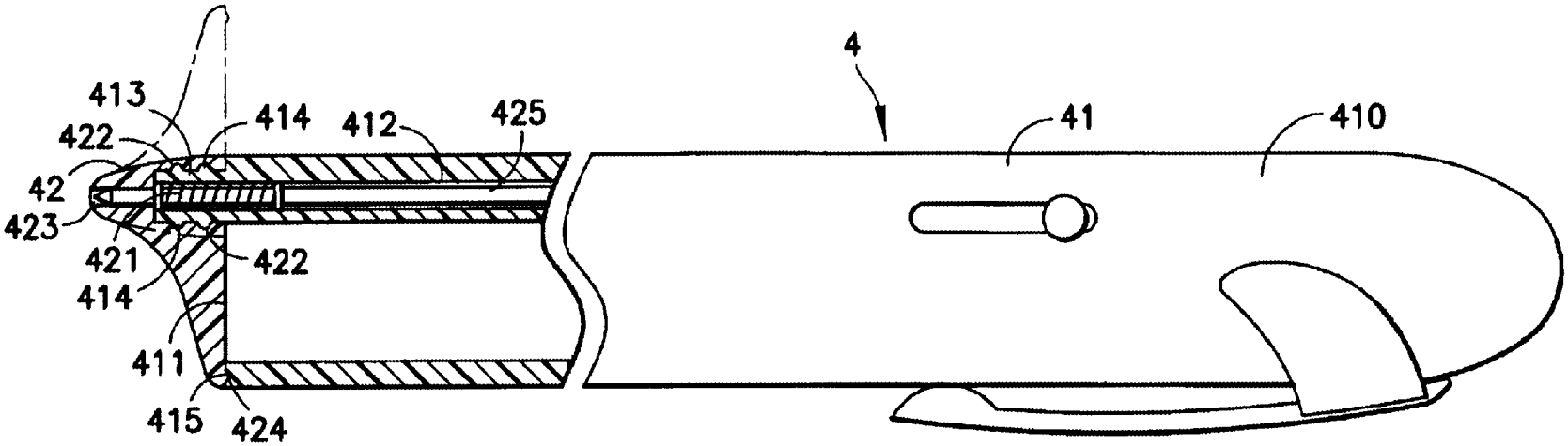
FIG. 4A is a partly sectional view of the sixth preferred embodiment of a pen for receiving eyeglasses according to the invention.

With reference to FIG. 4A, the sixth preferred embodiment of a pen 4 according to the present invention is shown to include a pen barrel 41 with a barrel body 410 and an open front end 411, and an openable front cap 42. This embodiment differs from the fifth preferred embodiment in that the front cap 42 has a rear end surface with an outer peripheral portion formed with a pivot hole 421, and an inner surface formed with two parallel annular grooves 422 in communication with the pivot hole 421. The barrel body 410 has a front end surface which includes an axially extending pivot pin 413 that extends integrally and forwardly therefrom, and that engages fittingly the pivot hole 421 in the front cap 42. The pivot pin 413 has an outer surface formed with two annular projections 414 that engage respectively and fittingly the annular grooves 422 in the front cap 42, whereby the front cap 42 can rotate about the pivot pin 413 along an axis that is parallel to the barrel body 410 for opening and closing of the front end 411 of the barrel body 410. In order to secure the front cap 42 on the front end 411 of the barrel body 410, the front cap 42 is provided with a boss 424 projecting therefrom and distal to the pivot pin hole 421, and the front end 411 of the pen barrel 41 is provided with an indentation 415 for engaging the boss 424 when the front cap 42 is rotated to a closed position. In addition, an axially extending cylindrical hole 412 is formed in the barrel body 410 to extend through the pivot pin 413. The front cap 42 further includes a through tip hole 423 that is communicated with the pivot pin hole 421 such that a writing instrument 425, such as a refill, can be accommodated in the hole 412 to extend through the pivot pin hole 421 and to project from the tip hole 423 for writing purposes. Compared with the above-described preferred embodiments, the writing instrument 425 is accommodated in both of the barrel body 410 and the front cap 42, and is of a longer length to make possible a longer period of writing.

Figure 4B:
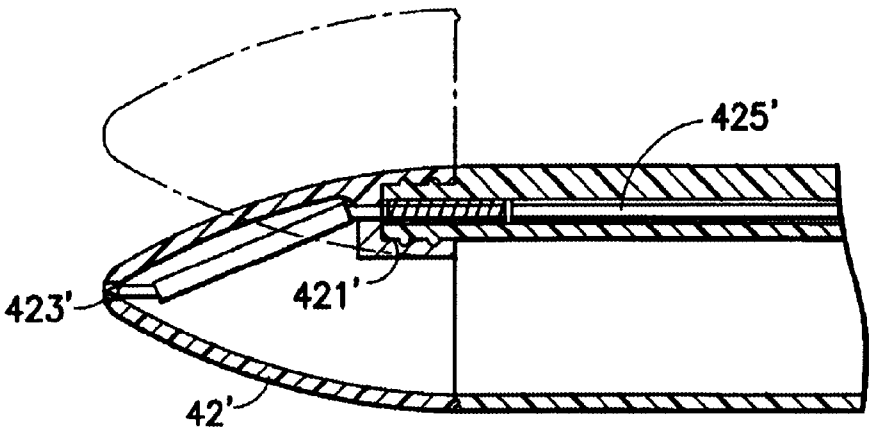
FIG. 4B is a fragmentary sectional view of a front cap and a pen barrel of the seventh preferred embodiment of the invention.

Referring to FIG. 4B, in the seventh preferred embodiment, a front section of the writing instrument 425' may be configured to pass through the pivot hole 421' and a bent through tip hole 423' of the front cap 42'.

A major advantage of the pen of the present invention is that the front cap of the pen is openable to permit access to the interior of the barrel body for storage or removal of the eyeglasses, while the rear cap is mounted fixedly to the barrel body. Compared with the prior art, which has a rear cap that is openable to allow access to the interior of the barrel body, arrangement of other functional accessories, such as a flashlight, is easier in terms of manufacture and assembly.

Figure 5:
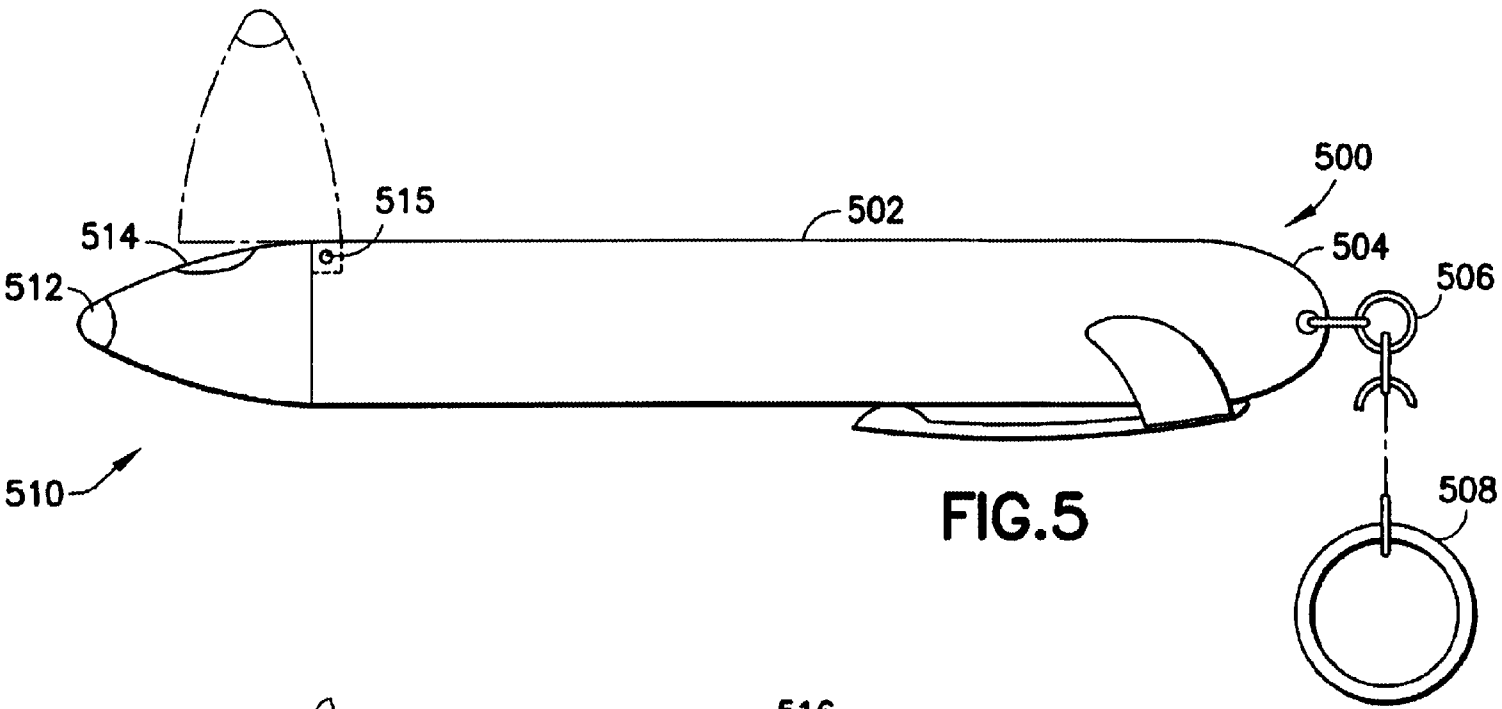
FIG. 5 is a view similar to that of FIG. 3 but showing a housing having a flashlight hingedly secured to one end in place of the writing tip and including an optional key chain secured to the opposite end.

Referring now to FIG. 5, another embodiment of the present invention is shown being indicated generally at 500. This embodiment includes an elongated generally cylindrically shaped barrel or housing 502, one end 504 of which is closed. A relatively short chain 506 with a key holding ring 508 at one end may be secured to the closed end 504 of housing 502 if desired. A flashlight assembly 510 is hinged to the opposite end of housing 502 and serves to provide access to the interior thereof for placement and removal of the eyeglasses. Preferably, flashlight assembly will include a high intensity light emitting diode 512, an associated power source and an actuating switch 514. Additionally, housing 502 may include a pocket clip similar to that shown in FIG. 1A or 3 above to facilitate carrying of the assembly in a shirt pocket.

As shown, when it is desired to replace or remove the eyeglasses from housing 502, one need merely pivot flashlight assembly 510 about the hinge axis 515 which extends generally perpendicular to the longitudinal axis of housing 502. Preferably, a small catch preferably located diametrically opposite hinge 515 will be provided to retain flashlight assembly 510 in a closed position.

It should be noted that while housing 502 has been illustrated with an integrally formed closed end portion similar to that shown in FIG. 1D above, a press fitted closure such as that shown in FIG. 1C or FIG. 2 may be utilized in lieu of the integrally formed arrangement. Additionally, one or the other or both of the pocket clip and key chain may be omitted from the assembly should this be desired.

Figure 6:
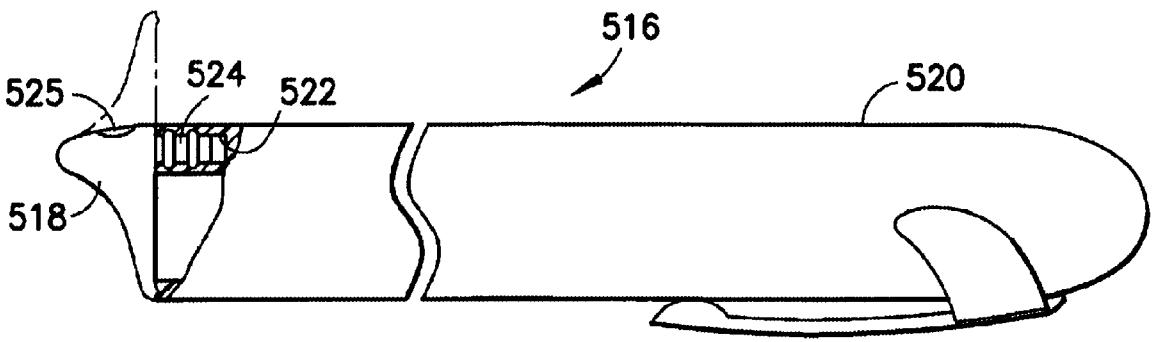
FIG. 6 is a view similar to that of FIG. 4 but showing a flashlight pivotably secured to one end of the housing in place of the writing tip.

FIG. 6 shows a modified flashlight 516 for receiving eyeglasses in which the flashlight assembly 518 is pivotable about an axis that runs parallel to but is radially offset from the longitudinal axis of housing 520. As shown, housing 520 is formed with a bore 522 which is adapted to received a pivot pin 524 which is integrally formed with flashlight assembly 518. Thus, in order to provide access to the interior of housing 520, flashlight assembly 518 is merely rotated about pivot pin 524 to thereby open or close the end of housing 520. As with assembly 500, flashlight assembly 520 will preferably be of the type utilizing a high efficiency, high intensity light emitting diode and will include both a power source supply and actuation switch 525.

Figure 7:
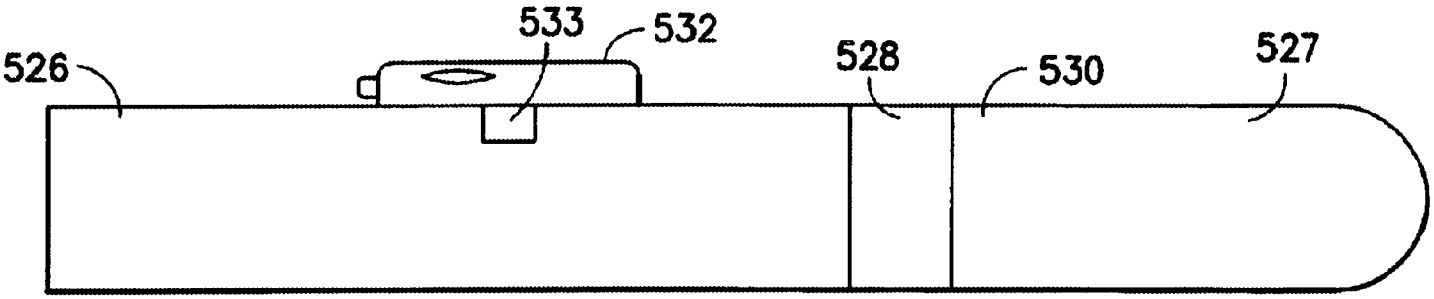
FIG. 7 is a view similar to FIG. 6 but showing another embodiment of the present invention.

FIG. 7 illustrates yet another embodiment of the present invention which includes a pair of elongated generally cylindrically shaped housing members 526, 527 each of which is formed with an integrally closed end and are open at the other ends. The two open ends 528, 530 are adapted to mate with each other to close off the space within the members which space is adapted to receive a pair of eyeglasses 531. In this embodiment, a flashlight assembly 532 is secured to a sidewall portion of one of the housing members 526, 527 in any suitable manner such as by welding, soldering, brazing or by means of a suitable adhesive. As shown, flashlight assembly 532 includes a strap 533 extending circumferentially about a portion of housing 526 to aid in its securement thereto. As above, flashlight assembly 532 will preferably utilize a high efficiency, high intensity light emitting diode and will contain both a suitable power source and actuation switch.

Figure 8:
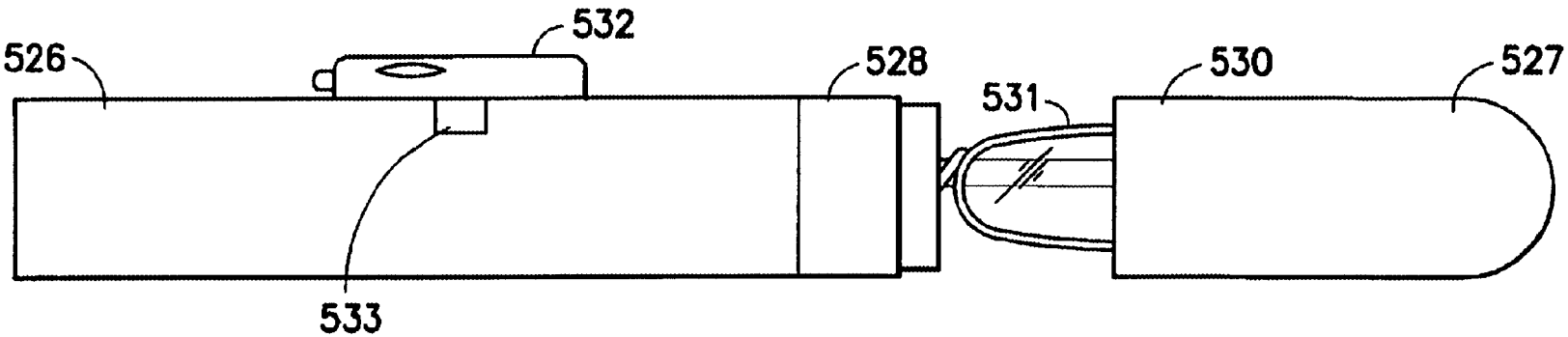
FIG. 8 is a view of the embodiment of FIG. 7 but showing the housing in an open position.
Figure 9:
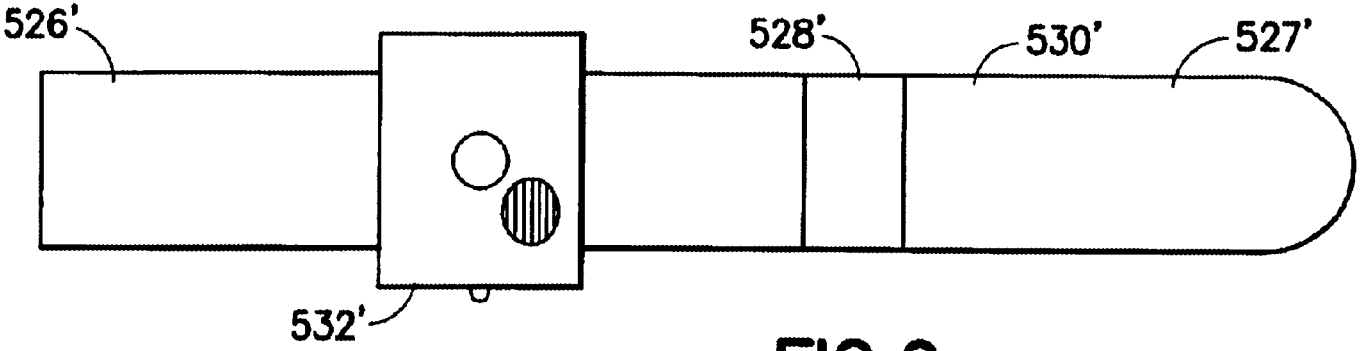
FIG. 9 is a plan view of a modified version of the embodiment of FIG. 7 in which the flashlight is pivotable with respect to the housing.

The embodiment shown in FIG. 9 is substantially identical to that of FIGS. 7 and 8 with the exception that flashlight assembly 532' is pivotably secured to one of housing members 526', 527' and thus may be rotated from a position in which its longitudinal axis is aligned with that of joined housing members 526', 527' to a position in which the respective axis are generally perpendicular to each other as seen in FIG. 9. Accordingly, corresponding portions are indicated by the same reference numbers primed.

Figure 10:
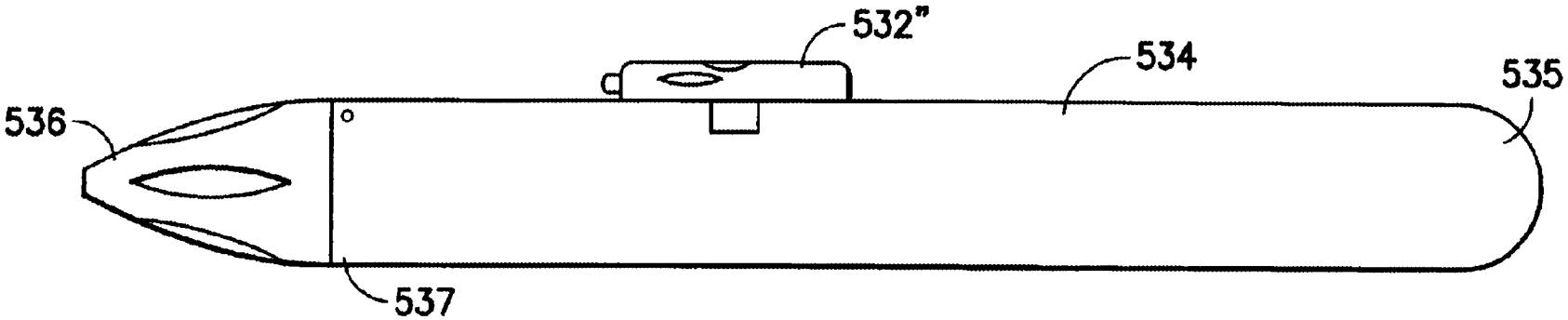
FIG. 10 is a view similar to that of FIG. 7 but showing yet another embodiment of the present invention.

FIG. 10 shows a further modification of the embodiments of FIGS. 7–9. In this embodiment, housing member is formed as a one piece elongated cylindrical member 534 one end 535 of which is closed. The opposite end 537 of housing 534 is open and is adapted to receive a writing instrument such as a pen assembly 536 as shown and described above. Pen assembly 536 will preferably be of the type shown and described with reference to FIG. 1A and may employ either a friction fit arrangement as with FIG. 1A or a pivot or hinge connection as also described above. In any event, pen assembly 536 will be movable to afford access to interior of housing 534 for removal and replacement of a pair of eyeglasses. Flashlight assembly 532" is substantially identical to flashlight assembly 532 above and is secured to housing 534 in either the manner described with reference to FIG. 7 or 9.

Figure 11:
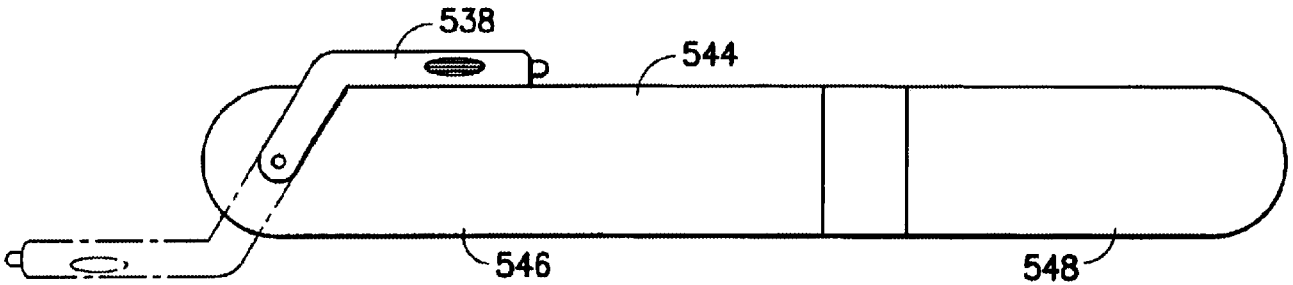
FIG. 11 is a view of a further embodiment of the present invention.
Figure 12:
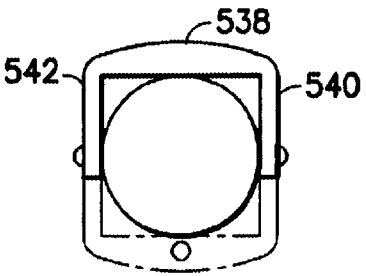
FIG. 12 is an end view of the embodiment shown in FIG. 11.

In FIGS. 11 and 12, flashlight assembly 538 is provided with a pair of arcuately shaped elongated arms 540, 542 extending from either side thereof. Arms 540 and 542 preferably extend downwardly along opposite sides of housing member 544 and are pivotably secured thereto so as to enable flashlight assembly 538 to be pivoted from a piggyback stored position to an extended position as shown in phantom. Housing member 544 is otherwise substantially identical to the housing described above with reference to FIG. 7 and includes separable joined portions 546, 548 each of which has integrally formed closed end portions.

Figure 13:
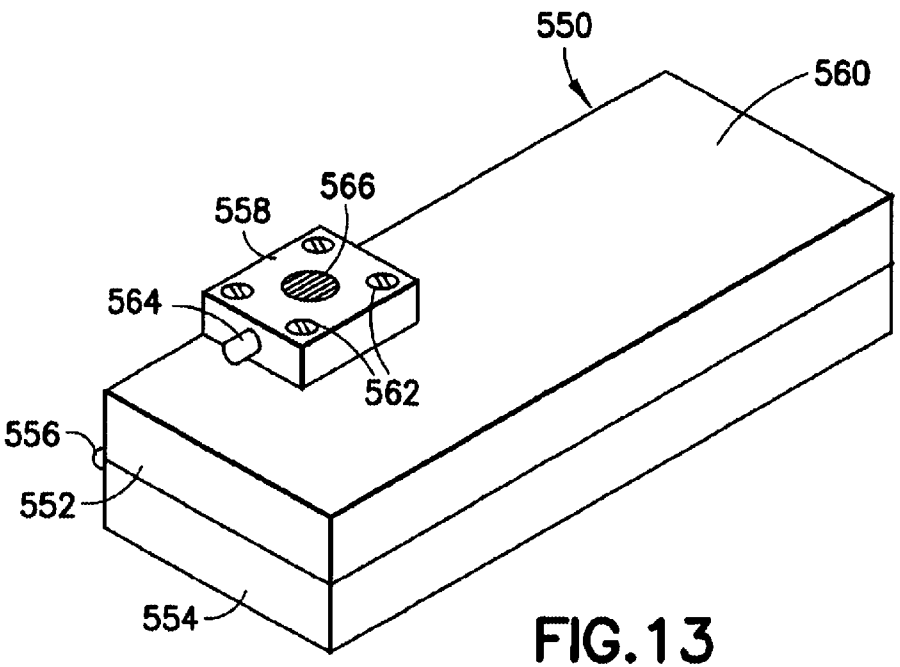
FIG. 13 is a perspective view of yet another embodiment of the present invention.

FIG. 13 shows yet another embodiment of the present invention and comprises a generally rectangular shaped housing 550 formed from a pair of generally identical portions 552, 554 which are hingedly connected along one of the abutting longitudinally extending sides 556 thereof. Housing 550 is adapted to contain a pair of eyeglasses with portions 552, 554 being operable in a clam shell fashion to enable removal and replacement of the eyeglasses. A flashlight assembly 558 is secured to an upper surface 560 of portion 552 in any suitable manner such as by screws 562. Flashlight assembly is similar to those described above and preferably includes a light source 564 in the form of a high efficiency high intensity light emitting diode, suitable power supply and an actuator switch 566.

Figure 14:
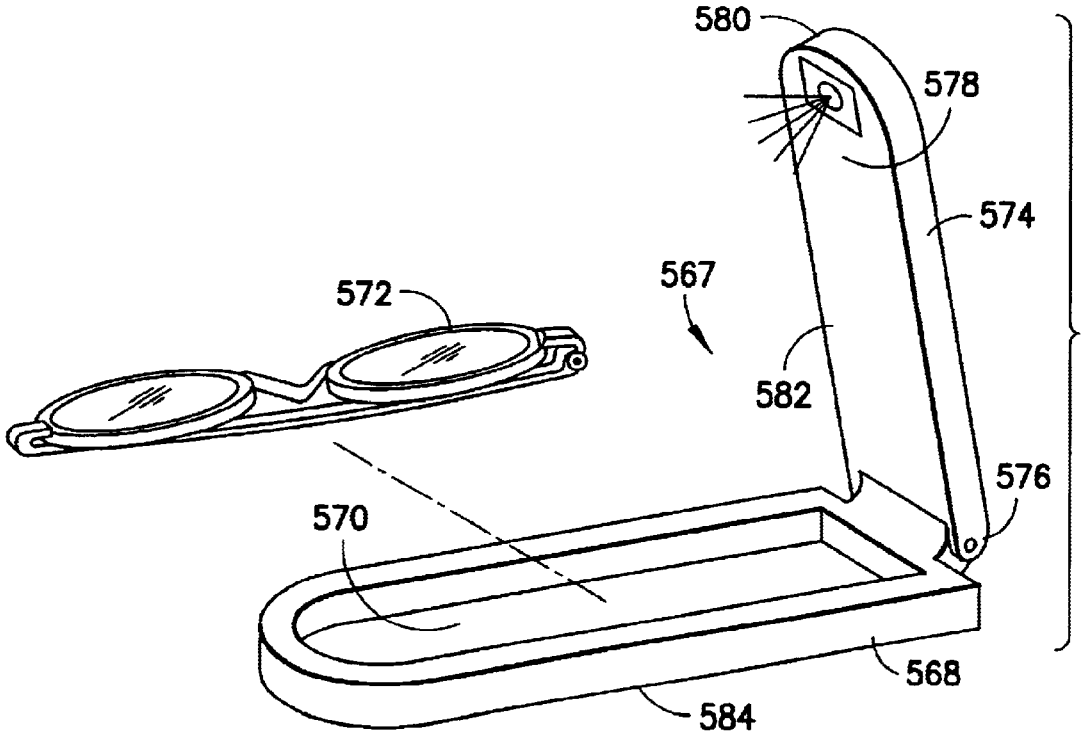
FIG. 14 is a view of yet another embodiment of the present invention in which a flashlight is integrated into one end of a hinged cover portion of the housing for containing the eyeglasses.
Figure 15:
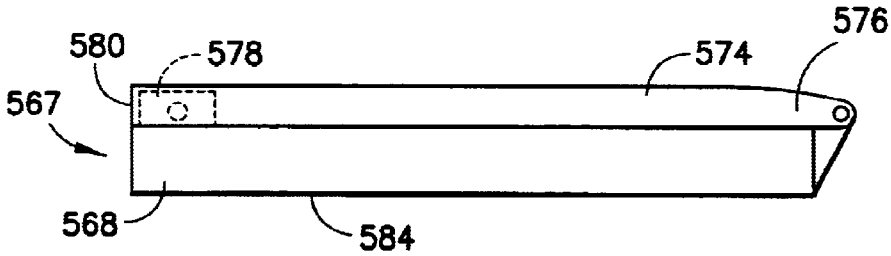
FIG. 15 is a view of the embodiment of FIG. 14 with the housing shown in a closed position.

Referring now to FIGS. 14 and 15, there is shown yet another embodiment of the present invention being indicated generally at 567. Eyeglass container 567 comprises a generally elongated housing including a lower portion 568 having an elongated cavity 570 formed in an upwardly facing portion thereof which cavity is adapted to receive a pair of eyeglasses 572. A cover portion 574 is hingedly connected to lower portion 568 at a longitudinal end 576 thereof and is movable between open and closed positions generally as shown in FIGS. 14 and 15 respectively to permit removal and replacement of eyeglasses 572 within cavity 570. Additionally, cover portion 574 includes a high intensity, high efficiency light emitting diode flashlight assembly 578 formed therein adjacent the end 580 opposite from the hinged end 576 thereof. As shown, flashlight assembly is positioned so as to project a light array outwardly from surface 582 of cover member 574 which surface faces the cavity 570 when cover member 574 is in a closed position.

Eyeglass case 567 is ideally suited for use in providing both a case for carrying of eyeglasses as well as a light source for viewing reading materials in areas of low illumination such as a menu in a dimly lit restaurant for example. For this purpose, it should be noted that the bottom surface 584 of lower portion 568 is generally planar so as to enable it to be easily supported on a generally horizontal surface. It is also noted that lower portion 568 is relatively thin thereby also enabling it to be positioned within a book with the cover portion in a raised position so as that flashlight assembly 578 may be employed to illuminate the pages thereof while the eyeglasses are used for reading of the printed material. Flashlight assembly 578 will incorporate a suitable power source within cover portion 574 and may incorporate a suitably located manually actuated on/off switch. Alternatively, an automatically actuated on/off switch that is operable to actuate flashlight assembly 578 upon opening of cover portion 574 may also be incorporated therein.

Figure 16:
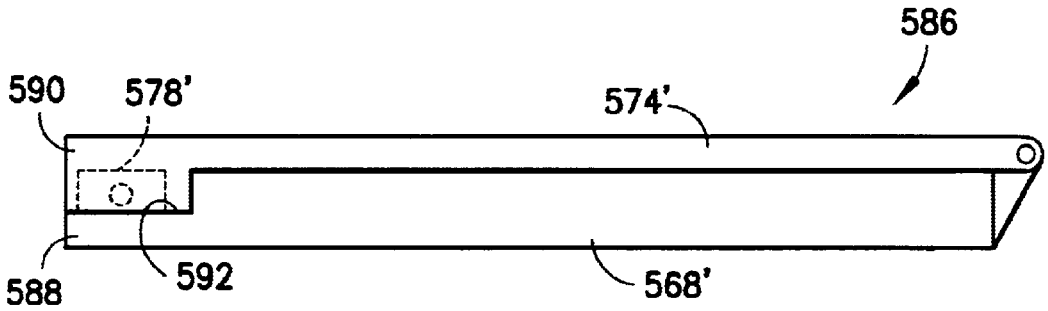
FIGS. 16 and 17 are modified versions of the embodiment shown in FIG. 14.

FIG. 16 shows a modified version of the eyeglass shown in FIGS. 14 and 15. Eyeglass case 586 is substantially identical to case 566 with the exception that lower portion 568' is formed with a reduced thickness extension 588 at the end opposite the hinge connection with cover portion 574'. Additionally, cover portion 574' includes an extension portion 590 of greater thickness than the remaining portion thereof. The increased thickness portion is designed to be received within the recess or cutout portion 592 defined by extension 588 and accommodates flashlight assembly 578'. In all other respects, eyeglass case 586 is substantially identical to that of eyeglass case 567 described above.

Figure 17:
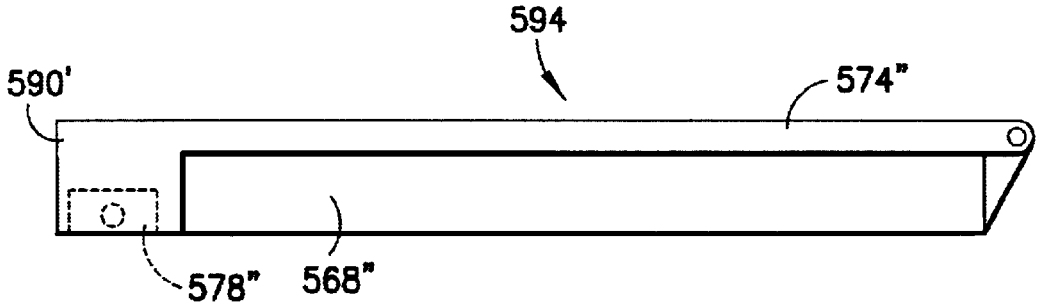

A further modified embodiment of eyeglass case 567 is shown in FIG. 17 being illustrated generally at 594. Eyeglass case 594 includes a lower portion 568" which is substantially identical to that of lower portion 568 shown in FIGS. 14 and 15. Cover portion 574" is similar to cover portion 574' shown in FIG. 16 with the exception that thickened end portion 590' has an overall thickness substantially equal to that of the thickness of eyeglass case 594. In all other respects, eyeglass case 594 is substantially the same in construction and operation as cases 567 and 586 described above.

Figure 18:
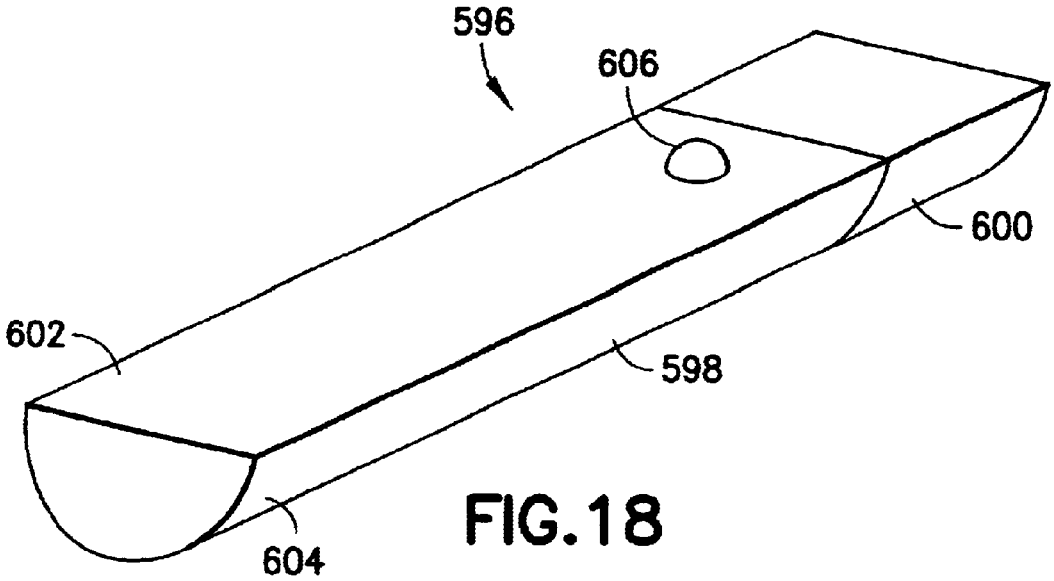
FIG. 18 shows yet another embodiment of the present invention.

A further embodiment of an eyeglass case 596 is shown in FIG. 18. As shown, eyeglass case 596 comprises an elongated housing 598 having a removable end portion 600 provided at one end thereof. Housing 598 as shown includes a generally planar upwardly facing surface 602 and a generally arcuately shaped lower surface 604. End portion 600 has a generally complementary cross sectional shape and may be secured to housing 598 by means of a pivot or hinged connection as described above or alternatively it may incorporate a threaded or telescopic sliding friction fit interconnection with housing 598. In any event, end portion 600 is designed to be movable relative to housing 598 so as to afford access to the interior thereof for removal or replacement of a pair of eyeglasses stored within housing 598. Additionally, housing 598 has a flashlight assembly 606 provided therein which is positioned so as to project an array of light outwardly from surface 602. As noted above, flashlight assembly will preferably include a high intensity, high efficiency light emitting diode as well as a suitable actuation switch and power supply.

Figure 19:
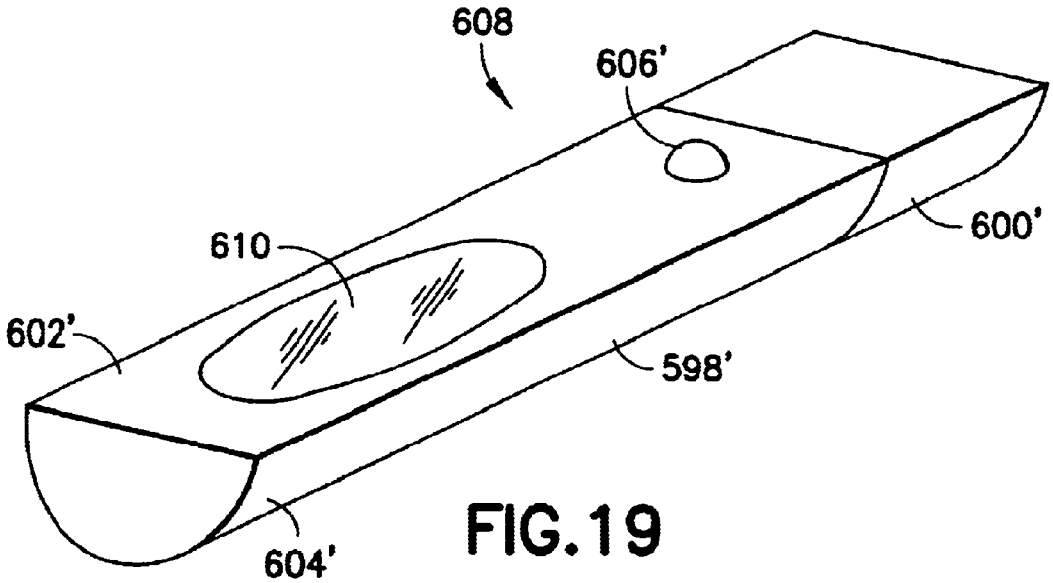
FIG. 19 is a slightly modified version of the embodiment shown in FIG. 18.

FIG. 19 shows eyeglass case 608 which is substantially identical to that of eyeglass case 596 with the only exception being that it incorporates a mirror 610 positioned along at least a portion of flat surface 602'. It should be noted that the arrangement of flashlight 606' and mirror 610 is such that they may both cooperate along with the use of the eyeglasses within housing 598' to enable a use to inspect their face or hair if desired.

As previously mentioned, any of the above describe embodiments may include a key chain attached thereto such as described with reference to FIG. 5 and/or the inclusion of a pocket clip as also described above. Further, with respect to the embodiments shown in FIGS. 7–12, 18 and 19 the two housing portions may be removably interconnected by means of a friction telescopic slip fit or alternatively a threaded or bayonet type interconnection may be utilized, the primary consideration being that the interconnection retain the portions together while being transported yet afford reasonably easy access to the eyeglasses contained therein. Further, while each of the embodiments described with reference to FIGS. 5–19 incorporates integrally formed closed end portions such as shown in FIG. 1D at one or both ends thereof, end portions such as shown in FIG. 1C or 2 may be substituted therefor. Also, while FIG. 10 shows an embodiment incorporating a writing instrument at one end thereof, any of the embodiments shown in FIG. 5, 6, 12, 18 or 19 may also incorporate a writing instrument at one end thereof.

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

What is claimed is:

1. A case for storage of a pair of eyeglasses, comprising:

a housing having an elongated first portion with a first end and a second end and an elongated second portion with a first end and a second end, which first portion and second portion together define a substantially enclosed space for accommodating said pair of eyeglasses when said first portion and said second portion are in a closed position;

wherein said first portion and said second portion are pivotably attached to one another at said first end of said first portion and said first end of said second portion such that said first portion and said second portion are relatively moveable with respect to each other to afford access to said enclosed space along substantially the entire length of each of said first portion and said second portion and to enable removal and replacement of said eyeglasses; and a flashlight provided on one of said first portion and said second portion.

2. The case as claimed in claim 1, wherein said second end of said first portion and said second end of said second portion are substantially adjacent one another when said first portion and said second portion are in the closed position.

3. The case as claimed in claim 2, further comprising a hinge interconnecting said first portion and said second portion at said first end of said first portion and said first end of said second portion.

4. The case as claimed in claim 2, wherein said flashlight includes a light emitting diode.

5. The case as claimed in claim 2, wherein said first portion and said second portion are hingedly interconnected at said first end of said first portion and said first end of said second portion.

6. The case as claimed in claim 2, wherein said flashlight is positioned so as to emit an array of light in a direction generally perpendicular to a surface of one of said first portion and said second portion.

7. A case for storage of a pair of eyeglasses, comprising:

a housing having a first portion and a second portion together defining a substantially enclosed space for accommodating said pair of eyeglasses when said first portion and said second portion are in a closed position;

said first portion and said second portion being relatively moveable with respect to each other to afford access to said enclosed space and to enable removal and replacement of said eyeglasses; and a flashlight provided on one of said first portion and said second portion;

wherein said second end of said first portion and said second end of said second portion are joined when said first portion and said second portion are in the closed position; and wherein said flashlight is pivotably secured to one of said first portion and said second portion.

8. The case as claimed in claim 7, wherein said flashlight includes a pair of spaced arm members, said arm members being pivotably secured to one of said first portion and said second portion.

9. A case for storage of a pair of eyeglasses, comprising:

a housing having a first portion and a second portion together defining a substantially enclosed space for accommodating said pair of eyeglasses when said first portion and said second portion are in a closed position;

said first portion and said second portion being relatively moveable with respect to each other to afford access to said enclosed space and to enable removal and replacement of said eyeglasses; and a flashlight provided on one of said first portion and said second portion;

wherein said second end of said first portion and said second end of said second portion are joined when said first portion and said second portion are in the closed position;

wherein said first portion and said second portion are hingedly interconnected; and wherein said first portion and said second portion are elongated and hingedly interconnected at one end thereof.

10. The case as claimed in claim 9, wherein said flashlight is positioned so as to emit an array of light in a direction generally perpendicular to a surface of one of said first portion and said second portion.

* * * * *